United States Patent [19]

Luksch et al.

[11] Patent Number: 4,785,687

[45] Date of Patent: Nov. 22, 1988

[54] MARINE PROPULSION DEVICE INCLUDING COMPRESSIVELY SECURED FLYWHEEL

[75] Inventors: Heinrich E. Luksch, Kenosha, Wis.; Richard M. McChesney, Waukegan, Ill.

[73] Assignee: Outboard Marine Corporation, Waukegan, Ill.

[21] Appl. No.: 830,230

[22] Filed: Feb. 18, 1986

[51] Int. Cl.[4] ..... G05G 1/10; B25G 3/08

[52] U.S. Cl. ..... 74/543; 74/572; 403/359; 403/380

[58] Field of Search ..... 74/543, 572, 573 R, 74/547; 403/260, 334, 359, 380

[56] References Cited

U.S. PATENT DOCUMENTS

| | | | |
|---|---|---|---|
| 2,081,053 | 5/1937 | Hobson | 74/543 |
| 2,353,431 | 7/1944 | Arden | 170/173 |
| 2,815,972 | 12/1957 | Lagervall | 287/54 |
| 2,886,358 | 5/1959 | Mumchbach | 403/359 |
| 3,061,341 | 10/1962 | Grzych et al. | 403/359 |
| 3,222,772 | 12/1965 | Leyner | 403/359 |
| 3,279,870 | 10/1966 | Janiszewski | 308/4 |
| 3,290,918 | 12/1966 | Weasler | 403/359 |
| 3,413,926 | 12/1968 | Ayson | 103/111 |
| 3,899,257 | 8/1975 | Gladieux | 403/259 |
| 4,019,490 | 4/1977 | Reese | 74/543 |
| 4,094,209 | 6/1978 | van Rossem et al. | 74/543 |
| 4,241,620 | 12/1980 | Pichl et al. | 74/573 |
| 4,262,552 | 4/1981 | Honda | 74/572 |
| 4,276,783 | 7/1981 | Anderson | 74/15.63 |
| 4,340,317 | 7/1982 | Heitmann et al. | 403/25 |
| 4,411,549 | 10/1983 | Sheppard | 403/258 |
| 4,520,688 | 6/1985 | Ban | 74/572 |

*Primary Examiner*—Gary L. Smith
*Assistant Examiner*—Vinh Luong
*Attorney, Agent, or Firm*—Michael, Best & Friedrich

[57] ABSTRACT

A marine propulsion device comprising a lower unit including a rotatably mounted propeller, and an internal combustion engine drivingly connected to the propeller, the engine including an engine block, a crankshaft rotatably supported by the engine block and including a generally cylindrical main portion and a tapered end portion connected to the main portion and projecting from the engine block, a flywheel mounted on the tapered end portion of the crankshaft, and a bolt engaging the flywheel and the main portion of the crankshaft for securing the flywheel to the crankshaft.

27 Claims, 1 Drawing Sheet

MARINE PROPULSION DEVICE INCLUDING COMPRESSIVELY SECURED FLYWHEEL

RELATED APPLICATION

Reference is made to the copending Mondek, et al. application Ser. No. 799,814, filed Nov. 10, 1985, now U.S. Pat. No. 4,697,556, and entitled "Crankshaft Bearing Arrangement for Marine Propulsion Devices".

BACKGROUND OF THE INVENTION

The invention relates to internal combustion engines for marine propulsion devices, and, more particularly, to means for securing the flywheel to the crankshaft of such internal combustion engines.

In the marine art, it is common to use tensile means (means placing a tensile load on the crankshaft) engaging the flywheel and the end of the crankshaft for securing the flywheel to the crankshaft. In the usual arrangement, the crankshaft has an externally threaded end, and a tapered portion located inwardly of the threaded end. The flywheel has a frustoconical aperture which receives the tapered portion of the crankshaft, and a nut threaded onto the end of the crankshaft secures the flywheel to the crankshaft by forcing the flywheel onto the tapered portion of the crankshaft.

This arrangement places a tensile load on the tapered portion of the crankshaft because the nut exerts an axially outward force on the end of the crankshaft, and the flywheel exerts an axially inward force spaced from the end of the crankshaft on the tapered portion of the crankshaft. This tends to "stretch" the tapered portion of the crankshaft in the axial direction, thereby lessening the junction between the flywheel and the crankshaft.

Typically, the flywheel is aligned with the crankshaft for timing purposes by slot and key means between the flywheel and the tapered portion of the crankshaft.

Attention is directed to the following U.S. patents:
Arden—U.S. Pat. No. 2,353,431—July 11, 1944
Lagervall—U.S. Pat. No. 2,815,972—Dec. 10, 1957
Janiszewski—U.S. Pat. No. 3,279,870—Oct. 18, 1966
Ayson—U.S. Pat. No. 3,413,926—Dec. 3, 1968
Gladieux—U.S. Pat. No. 3,899,257—Aug. 12, 1975
Pichl,—U.S. Pat. No. 4,241,620—Dec. 30, 1980
Honda—U.S. Pat. No. 4,262,552—Apr. 21, 1981
Anderson—U.S. Pat. No. 4,276,783—July 7, 1981
Heitmann—U.S. Pat. No. 4,340,317—July 20, 1982
Sheppard—U.S. Pat. No. 4,411,549—Oct. 25, 1983
Ban—U.S. Pat. No. 4,520,688—June 4, 1985

SUMMARY OF THE INVENTION

The invention provides a marine propulsion device comprising a lower unit including a rotatably mounted propeller, and an internal combustion engine drivingly connected to the propeller, the engine including an engine block, and a crankshaft and flywheel assembly. The crankshaft and flywheel assembly includes a crankshaft rotatably supported by the engine block and including a generally cylindrical main portion and a tapered end portion connected to the main portion and projecting from the engine block, a flywheel mounted on the tapered end portion of the crankshaft, and compressive means engaging the flywheel and the main portion of the crankshaft for securing the flywheel to the crankshaft.

The invention also provides an internal combustion engine as described above, and a crankshaft and flywheel assembly as described above.

The invention also provides that the crankshaft has a longitudinal axis, and the compressive means includes a bolt having a head engaging the flywheel, the bolt extending along the longitudinal axis and through the end portion of the crankshaft and threadedly engaging the main portion of the crankshaft.

The invention also provides that the tapered end portion has an outer end, the flywheel includes a generally frustoconical aperture receiving the tapered end portion of the crankshaft and having an end adjacent the outer end of the tapered end portion, and a surface surrounding the end of the aperture and facing away from the main portion of the crankshaft, the head of the bolt engages the flywheel surface, and the bolt extends through the aperture.

The invention also provides that the bolt threadedly engages only the main portion of the crankshaft.

The invention also provides that the bolt extends a substantial distance beyond the tapered end portion into the main portion of the crankshaft.

The invention also provides that the tapered end portion has a length, and the bolt extends into the crankshaft a distance at least approximately equal to two times the length of the end portion.

The invention also provides that the tapered end portion has a length, the bolt has a diameter, and the bolt extends into the crankshaft a distance at least approximately equal to the length of the tapered end portion plus three times the diameter of the bolt.

The invention also provides that the crankshaft rotates in one direction about the longitudinal axis and relative to the engine block, and the bolt is threaded into the crankshaft by rotating the bolt in the opposite direction about the longitudinal axis and relative to the engine block, whereby rotation of the crankshaft causes tightening of the bolt.

The invention also provides that the main portion of the crankshaft has a diameter, and the bolt extends into the crankshaft a distance at least approximately equal to two times the diameter.

The invention also provides that the main portion of the crankshaft has a diameter, and the bolt has a diameter of between 0.20 to 0.40 times the diameter of the main portion of the crankshaft.

The invention also provides that the tapered end portion has an outer end and a length, and the bolt has a threaded portion spaced from the outer end a distance equal to approximately 1.1 times the length of the tapered end portion.

The invention also provides that the main portion of the crankshaft has a generally cylindrical outer surface, and a plurality of splines spaced circumferentially around the outer surface, and the flywheel includes a plurality of complementary splines engaging the splines on the outer surface.

A principal feature of the invention is the provision of a crankshaft and flywheel assembly comprising compressive means engaging the flywheel and the main portion of the crankshaft for securing the flywheel to the crankshaft. Because the compressive securing means engages the main portion of the crankshaft, i.e., engages the crankshaft axially inwardly of the tapered portion, a compressive load is placed on the tapered portion of the crankshaft. The load is compressive because the securing means exerts an axially outward force on the main portion, and exerts an axially inward force on the flywheel and therefore on the tapered portion of the crankshaft. This compressive load causes the tapered portion to "spread" in the radial direction, thereby improving the junction between the flywheel and the crankshaft.

Another principal feature of the invention is the provision of the above-described compressive means including a bolt having a head engaging the flywheel, the bolt extending along the longitudinal axis of the crankshaft and through the tapered end portion of the crankshaft and threadedly engaging only the main portion of the crankshaft. Because the bolt threadedly engages only the main portion of the crankshaft, the tapered portion is completely under compression, and the engagement of the bolt with the crankshaft does not generate heat in the tapered portion.

Various other features and advantages of the invention will become apparent to those skilled in the art upon review of the following detailed description, claims, and drawings.

Figure 1:
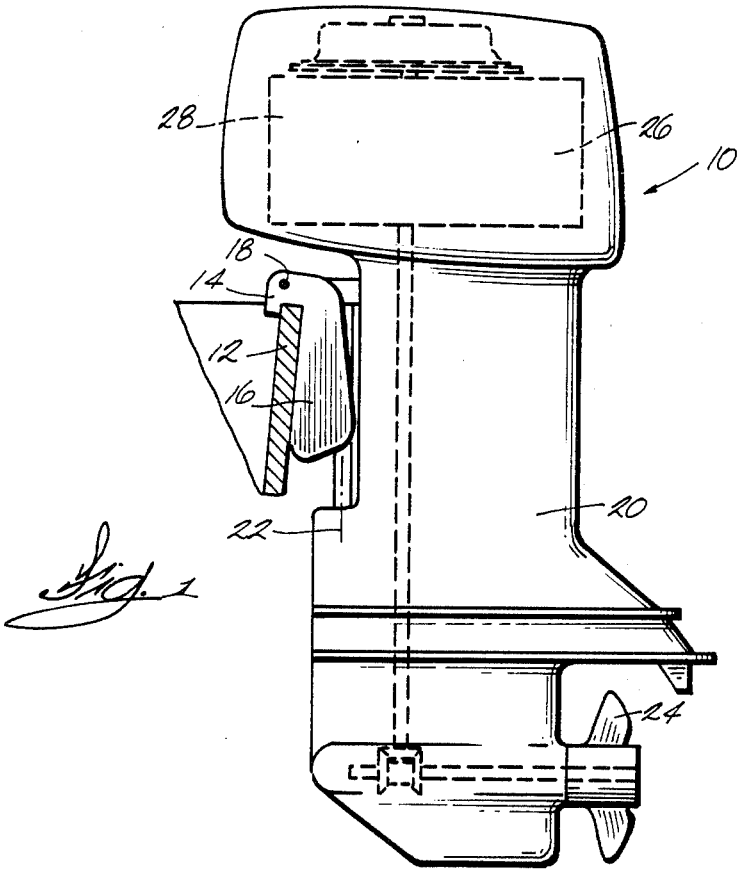
FIG. 1 is a side elevational view of a marine propulsion device which includes a crankshaft and flywheel assembly and which embodies various of the features of the invention.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting

DESCRIPTION OF THE PREFERRED EMBODIMENT

A marine propulsion device 10 embodying the invention is illustrated in the drawings. As best shown in FIG. 1, the marine propulsion device 10 comprises a mounting assembly fixedly attached to the transom 12 of a boat. While various suitable mounting assemblies can be employed, in the preferred embodiment, the mounting assembly includes a transom bracket 14 fixedly attached to the transom 12, and a swivel bracket 16 mounted on the transom bracket 14 for pivotal movement of the swivel bracket 16 relative to the transom bracket 14 about a generally horizontal tilt axis 18.

The marine propulsion device 10 also comprises a propulsion unit 20 mounted on the swivel bracket 16 for pivotal movement of the propulsion unit 20 relative to the swivel bracket 16 about a generally vertical steering axis 22. The propulsion unit 20 includes a lower unit including a rotatably mounted propeller 24, and an internal combustion engine 26 mounted on the lower unit and drivingly connected to the propeller 24. The engine 26 includes an engine block 28, and a crankshaft and flywheel assembly.

Figure 2:
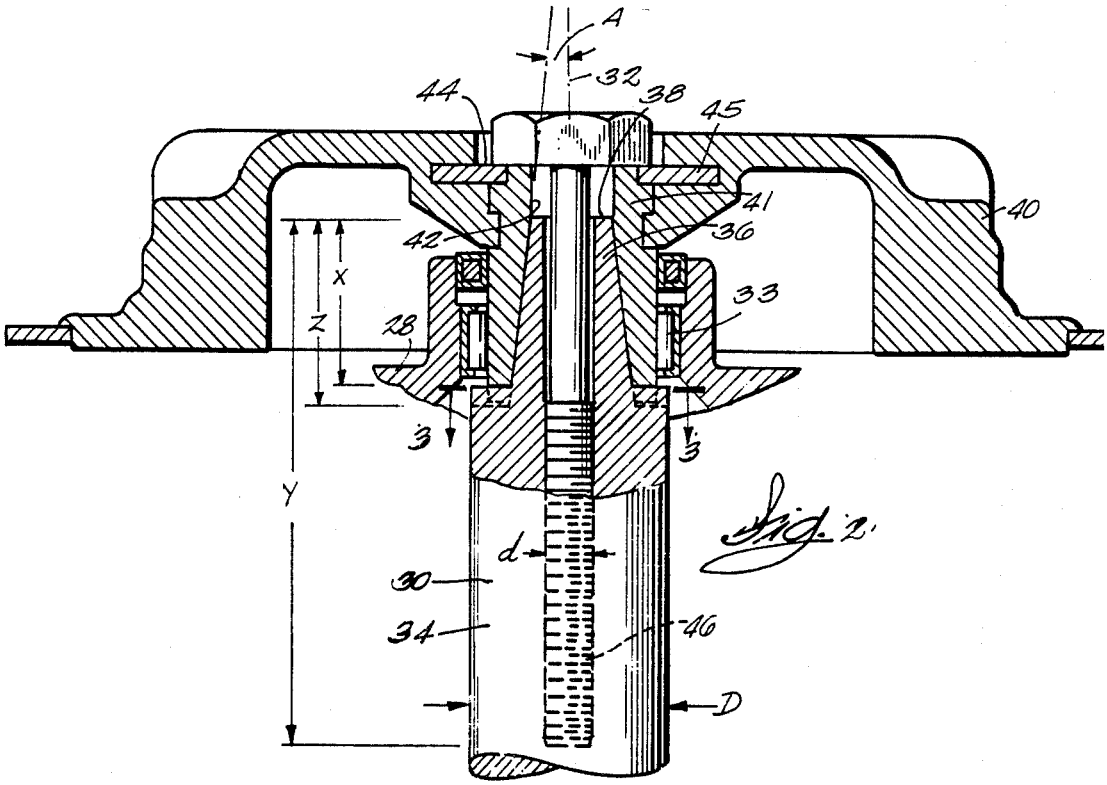
FIG. 2 is a partial, vertical, cross-sectional view of the crankshaft and flywheel assembly shown in FIG. 1.

The crankshaft and flywheel assembly includes a generally vertical crankshaft 30 having a longitudinal axis 32 and being supported from the engine block 28 for rotation about the longitudinal axis 32 by suitable bearing means, such as, for instance, bearing 33. The crankshaft 30 includes a generally cylindrical main portion 34 having a diameter D and an outer surface, and a tapered end portion 36 having an upper or outer end 38 and being connected to the main portion 34. The tapered end portion 36 has a length X and projects from the upper end of the engine block 28. Preferably, as shown in FIG. 2, the angle A formed by the tapered end portion 36 and the longitudinal axis 32 of the crankshaft 30 is less than 45°. In the preferred embodiment, the crankshaft 30 rotates in one direction about the longitudinal axis 32 and relative to the engine block 28.

The crankshaft and flywheel assembly also includes a flywheel 40 mounted on the tapered end portion 36 of the crankshaft 30. In the illustrated construction, the flywheel 40 includes a hub 41 having an upper end and having therein a generally frustoconical aperture 42 complementary with and receiving the tapered end portion 36 of the crankshaft 30. The aperture 42 has an upper end adjacent the upper or outer end 38 of the tapered portion 36 of the crankshaft 30. In the illustrated construction, the upper end of the aperture 42 is spaced slightly above the upper end 38 of the tapered end portion 36 and coincides with the upper end of the flywheel hub 41. The flywheel 40 also includes an upper surface 44 surrounding the upper end of the aperture 42 and facing away from the main portion 34 of the crankshaft 30. In the illustrated construction, the upper surface 44 is defined by the upper surface of a washer 45 integrally connected to the flywheel 40, and by the upper end of the flywheel hub 41.

The crankshaft and flywheel assembly further includes compressive means engaging the flywheel 40 and the main portion 34 of the crankshaft 30 for securing the flywheel 40 to the crankshaft 30. By "compressive" it is meant that the crankshaft 30, and particularly the tapered end portion 36 of the crankshaft 30, is placed under a compressive load, which tends to "spread" the crankshaft radially, rather than a tensile load, which tends to "stretch" the crankshaft axially. While various suitable compressive means can be employed, in the preferred embodiment, the compressive means includes a bolt 46 having a head engaging the flywheel 40. Preferably, the bolt head engages the upper surface 44 of the flywheel 40. The bolt 46 extends along the longitudinal axis 32, extends through the flywheel aperture 42 and the tapered end portion 36 of the crankshaft 30, and threadedly engages the main portion 34 of the crankshaft 30. In the preferred embodiment, as shown in FIG. 2, the bolt 46 extends a substantial distance beyond the tapered end portion 36 into the main portion 34 and threadedly engages only the main portion 34 of the crankshaft 30.

In the preferred embodiment, the bolt 46 has a diameter d and extends into the crankshaft 30 a distance Y at least approximately equal to two times the length X of the tapered end portion 36, at least approximately equal to the length X plus three times the diameter d ($X+3d$), and at least approximately equal to two (preferably between 2.0 and 2.5) times the diameter D of the main portion 34. Furthermore, the diameter d of the bolt 46 is approximately equal to 0.20 (preferably between 0.20 and 0.40) times the diameter D of the main portion 34 of the crankshaft 30, and the bolt 46 has a threaded portion which is spaced from the upper end 38 of the crankshaft 30 a distance Z equal to approximately 1.1 times the length X of the tapered end portion 36. Furthermore, the bolt 46 is threaded into the crankshaft 30 by rotating the bolt 46 in the direction opposite that in which the crankshaft 30 rotates relative to the engine block 28, so that normal operating rotation of the crankshaft 30 causes tightening of the bolt 46 in the crankshaft 30.

Figure 3:
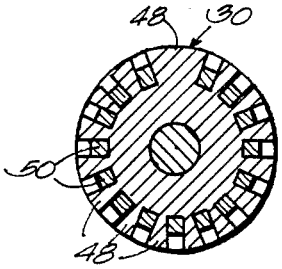
FIG. 3 is a cross-sectional view taken along line 3—3 in FIG. 2.

As best shown in FIG. 3, the crankshaft and flywheel assembly preferably also includes means for aligning the flywheel 40 with the crankshaft 30 for timing purposes. While various suitable aligning means can be used, in the illustrated construction, the aligning means includes, on the outer surface of the main portion 34 of the crankshaft 30, a plurality of splines 48 spaced circumferentially therearound, and, on the flywheel 40, a plurality of complementary splines 50 engaging the splines 48 on the crankshaft 30. One of the splines 48 on the crankshaft 30 is larger than the others in order to provide correct location of the flywheel 40 relative to the crankshaft 30. Other means, such as aligned stickers on the flywheel 40 and crankshaft 30, can be used for correctly locating the flywheel 40 relative to the crankshaft 30.

Various other features and advantages of the invention are set forth in the following claims.

We claim:

1. A marine propulsion device comprising a lower unit including a rotatably mounted propeller, and an internal combustion engine drivingly connected to said propeller, said engine including an engine block, a flywheel including a frustroconical aperture defined by a tapering surface, a crankshaft rotatably supported by said engine block and including a generally cylindrical main portion and a tapered end portion connected to said main portion, projecting from said engine block, received in said frustroconical aperture, and defined by a tapering surface engaging said tapering surface of said flywheel, and means engaging said flywheel and said main portion of said crankshaft and without direct force transmission between said tapered end portion and said engaging means for compressively engaging said tapered end portion of said crankshaft against said tapered portion of said flywheel so as to compressively secure said flywheel to said crankshaft.

2. A marine propulsion device as set forth in claim 1 wherein said frustroconical aperture has an end, wherein said flywheel includes a transverse surface surrounding said end of said aperture and facing away from said main portion of said crankshaft, wherein said means engaging said flywheel and said main portion of said crankshaft includes a bolt having a head engaging said flywheel transverse surface, and wherein said bolt extends through said aperture.

3. A marine propulsion device as set forth in claim 1 wherein said bolt extends a substantial distance beyond said tapered end portion into said main portion of said crankshaft.

4. A marine propulsion device as set forth in claim 3 wherein said tapered end portion has a length, and wherein said bolt extends into said crankshaft a distance at least approximately equal to two times said length of said end portion.

5. A marine propulsion device as set forth in claim 3 wherein said tapered end portion has a length, wherein said bolt has a diameter, and wherein said bolt extends into said crankshaft a distance at least approximately equal to said length of said tapered end portion plus three times said diameter of said bolt.

6. A marine propulsion device as set forth in claim 1 wherein said main portion of said crankshaft has a diameter, and wherein said bolt extends into said crankshaft a distance at least approximately equal to two times said diameter.

7. A marine propulsion device as set forth in claim 1 wherein said main portion of said crankshaft has a diameter, and wherein said bolt has a diameter of between 0.20 to 0.40 times said diameter of said main portion of said crankshaft.

8. A marine propulsion device as set forth in claim 1 wherein said tapered end portion has an outer end and a length, and wherein said bolt has a threaded portion spaced from said outer end a distance equal to approximately 1.1 times said length of said tapered end portion.

9. A marine propulsion device as set forth in claim 1 wherein said main portion of said crankshaft has a generally cylindrical outer surface, and a plurality of splines spaced circumferentially around said outer surface, and wherein said flywheel includes a plurality of complementary splines engaging said splines on said outer surface.

10. A marine propulsion device comprising a lower unit including a rotatably mounted propeller, and an internal combustion engine drivingly connected to said propeller, said engine including an engine block, a flywheel including a frustroconical aperture defined by a tapering surface, a crankshaft rotatably supported by said engine block and including a longitudinal axis, a generally cylindrical main portion, and a tapered end portion connected to said main portion, projecting from said engine block, received in said frustroconical aperture, and defined by a tapering surface engaging said tapering surface of said flywheel, and means engaging said flywheel and said main portion of said crankshaft for compressively engaging said flywheel to said crankshaft and including a bolt having a head engaging said flywheel and extending along said longitudinal axis and through said end portion of said crankshaft and threadedly engaging only said main portion of said crankshaft.

11. A marine propulsion device comprising a lower unit including a rotatably mounted propeller, and an internal combustion engine drivingly connected to said propeller, said engine including an engine block, a flywheel including a frustroconical aperture defined by a tapering surface, a crankshaft including a longitudinal axis and supported by said engine block for rotation in one direction about said longitudinal axis and relative to said engine block, said crankshaft also including a generally cylindrical main portion, a tapered end portion connected to said main portion and projecting from said engine block, received in said frustroconical aperture, and defined by a tapering surface engaging said tapering surface of said flywheel, and means engaging said flywheel and said main portion of said crankshaft for compressively engaging said flywheel to said crankshaft and including a bolt having a head engaging said flywheel, said bolt extending along said longitudinal axis and through said end portion of said crankshaft and threadedly engaging said main portion of said crankshaft by rotating said bolt in the opposite direction about said longitudinal axis and relative to said engine block, whereby rotation of said crankshaft causes tightening of said bolt.

12. An internal combustion engine comprising an engine block, a flywheel including a frustronconical aperture defined by a tapering surface, a crankshaft rotatably supported by said engine block and including a generally cylindrical main portion, a tapered end portion connected to said main portion, projecting from said engine block, received in said frustroconical aperature, and defined by a tapering surface engaging said tapering surface of said flywheel, and means engaging said flywheel and said main portion of said crankshaft for compressively engaging said flywheel and said crankshaft.

13. An engine as set forth in claim 12 wherein said frustroconical aperture has an end, wherein said flywheel includes a transverse surface surrounding said end of said aperture and facing away from said main portion of said crankshaft, wherein said means engaging said flywheel and said main portion of said crankshaft includes a bolt having a head engaging said flywheel transverse surface, and wherein said bolt extends through said aperture.

14. An engine as set forth in claim 12 wherein said bolt threadedly engages only said main portion of said crankshaft.

15. An engine as set forth in claim 12 wherein said bolt extends a substantial distance beyond said tapered end portion into said main portion of said crankshaft.

16. An engine as set forth in claim 15 wherein said tapered end portion has a length, and wherein said bolt extends into said crankshaft a distance at least approximately equal to two times said length of said end portion.

17. An engine as set forth in claim 15 wherein said tapered end portion has a length, wherein said bolt has a diameter, and wherein said bolt extends into said crankshaft a distance at least approximately equal to said length of said tapered end portion plus three times said diameter of said bolt.

18. An engine as set forth in claim 12 wherein said crankshaft rotates in one direction about said longitudinal axis and relative to said engine block, and wherein said bolt is threaded into said crankshaft by rotating said bolt in the opposite direction about said longitudinal axis and relative to said engine block, whereby rotation of said crankshaft causes tightening of said bolt.

19. An engine as set forth in claim 12 wherein said main portion of said crankshaft has a diameter, and wherein said bolt extends into said crankshaft a distance at least approximately equal to two times said diameter.

20. An engine as set forth in claim 12 wherein said main portion of said crankshaft has a diameter, and wherein said bolt has a diameter of between 0.20 to 0.40 times said diameter of said main portion of said crankshaft.

21. An engine as set forth in claim 12 wherein said tapered end portion has an outer end and a length, and wherein said bolt has a threaded portion spaced from said outer end a distance equal to approximately 1.1 times said length of said tapered end portion.

22. An engine as set forth in claim 12 wherein said main portion of said crankshaft has a generally cylindrical outer surface, and a plurality of splines spaced circumferentially around said outer surface, and wherein said flywheel includes a plurality of complementary splines engaging said splines on said outer surface.

23. An internal combustion engine comprising an engine block, a crankshaft rotatably supported by said engine block, said crankshaft having a longitudinal axis and including a generally cylindrical main portion having a diameter, and a tapered end portion defined by a tapering surface, connected to said main portion and having an outer end, said end portion having a length and projecting from said engine block, said crankshaft rotating in one direction about said longitudinal axis and relative to said engine block, a flywheel mounted on said tapered end portion of said crankshaft, said flywheel including a generally frustroconical aperture receiving said tapered end portion, defined by a tapering surface in engaged relation with said tapering surface of said end portion of said crankshaft, and having an end adjacent said outer end of said tapered end portion, and a transverse surface surrounding said end of said aperture and facing away from said main portion of said crankshaft, and a bolt having a head engaging said flywheel transverse surface, said bolt extending along said longitudinal axis and through said aperture and said end portion of said crankshaft, said bolt having a diameter and extending into said crankshaft a distance at least approximately equal to two times said length of said end portion, at least approximately equal to said length of said tapered end portion plus three times said diameter of said bolt, and at least approximately equal to two times said diameter of said main portion of said crankshaft, said diameter of said bolt being between 0.20 to 0.40 times said diameter of said main portion of said crankshaft, said bolt threadedly engaging only said main portion of said crankshaft and having a threaded portion spaced from said outer end of said tapered end portion a distance equal to approximately 1.1 times said length of said tapered end portion, and said bolt being threaded into said crankshaft by rotating said bolt in the direction opposite said one direction about said longitudinal axis and relative to said engine block whereby rotation of said crankshaft causes tightening of said bolt and whereby said bolt compressively engages said tapering surface defining said aperture in said flywheel with said tapering surface defining said end portion of said crankshaft.

24. An engine as set forth in claim 23 wherein said main portion of said crankshaft has a generally cylindrical outer surface, and a plurality of splines spaced circumferentially around said outer surface, and wherein said flywheel includes a plurality of complementary splines engaging said splines on said outer surface.

25. A crankshaft and flywheel assembly comprising a flywheel including a frustronconical aperture defined by a tapering surface, a crankshaft including a generally cylindrical main portion, and a tapered end portion connected to said main portion, received in said frustroconical aperture, and defined by a tapering surface engaging said tapering surface of said flywheel, and means engaging said flywheel and said main portion of said crankshaft for compressively engaging said flywheel and said crankshaft and including a bolt having a head engaging said flywheel, extending through said end portion of said crankshaft without direct force transmission therebetween, and threadedly engaging only said main portion of said crankshaft so as to effect compressive engagement between said tapered end portion of said crankshaft and said flywheel.

26. An engine including an engine block, a crankshaft rotatably supported by said engine block and including a generally cylindrical main portion and a tapered end portion connected to said main portion and projecting from said engine block, a flywheel including an aperture having a tapered portion receiving said tapered end portion in engaged relation, and a bolt having a head engaging said flywheel, extending through said end portion of said crankshaft without direct force transmission therebetween, and threadedly engaging only said main portion of said crankshaft.

27. A marine propulsion device comprising a lower unit including a rotatably mounted propeller, and an internal combustion engine drivingly connected to said propeller, said engine including an engine block, a crankshaft rotatably supported by said engine block and including a generally cylindrical main portion and a tapered end portion connected to said main portion, projecting from said engine block, and having an outer surface, a flywheel mounted on said tapered end portion of said crankshaft and including a transverse surface spaced from said end of said tapered end portion, and an aperture extending downwardly from said transverse surface and including a tapered portion defining an inner surface receiving said outer surface of said tapered end portion in engaged realtion, and means engaging said flywheel and said main portion of said crankshaft for compressing said tapered portion of said crankshaft against said tapered portion of said flywheel so as to secure said flywheel to said crankshaft, said means comprising a bolt having a head engaging said trnasverse surface of said flywheel, said bolt extending in said aperture, extending through said end portion of said crankshaft without force transmission therebetween, and threadedly engaging only said main portion of said crankshaft.

* * * * *